United States Patent [19]

Steele

[11] Patent Number: 4,540,228

[45] Date of Patent: Sep. 10, 1985

[54] LOW INSERTION FORCE CONNECTOR WITH IMPROVED CAM ACTUATOR

[75] Inventor: Thomas S. Steele, Roseville, Minn.

[73] Assignee: Sperry Corporation, New York, N.Y.

[21] Appl. No.: 508,361

[22] Filed: Jun. 27, 1983

[51] Int. Cl.[3] ..... H01R 13/62

[52] U.S. Cl. ..... 339/74 R; 339/176 MP

[58] Field of Search ..... 339/74 R, 75 MP, 176 MP

[56] References Cited

U.S. PATENT DOCUMENTS

| | | | |
|---|---|---|---|
| 3,899,234 | 8/1975 | Yeager et al. | 339/75 MP |
| 3,963,317 | 6/1976 | Eigenbrode et al. | 339/74 R |
| 4,159,154 | 6/1979 | Arnold | 339/75 MP |
| 4,179,177 | 12/1979 | Lapraik | 339/74 R |
| 4,196,955 | 4/1980 | Anhalt | 339/75 MP |

*Primary Examiner*—John McQuade

*Attorney, Agent, or Firm*—Charles A. Johnson; Kenneth T. Grace; Marshall M. Truex

[57] ABSTRACT

A low insertion force connector for making electrical connection between electrical contacts on a printed circuit board assembly and external circuitry, and having an improved linear cam actuating mechanism is described. An elongated outer housing having a centrally located opening with a longitudinal channel along the bottom thereof, has spaced apart ramps positioned at the bottom of the channel. The housing has an aperture at each end thereof, and has external ramps on each end of the outer housing in a predetermined relationship to the associated aperture. A plurality of contacts are mounted within the outer housing on either side of the channel, with first ends interior the housing being bowed inwardly for contacting the printed circuit board assembly, and second ends extending through said outer housing for making electrical connection to external circuitry. An elongated cam actuator having grooves along the sides thereof, has a bottom surface configured to mate with the ramps at the bottom of the channel, and is of a length sufficient to extend through both of the apertures in the ends of said outer housing. The cam actuator has mating ramps configured to cooperate with the external ramps. An inner shell is slideably mounted to the cam actuator and is positioned in the opening in the outer housing. The inner shell has upright members for engaging the contacts and forcing them to move laterally out of contact with printed circuit board assembly when the cam actuator engage the external ramps and force the shell downwardly.

11 Claims, 15 Drawing Figures

LOW INSERTION FORCE CONNECTOR WITH IMPROVED CAM ACTUATOR

BACKGROUND OF THE INVENTION

1. Field of the Invention

This invention relates generally to electrical connectors for use with printed circuit board assemblies. More particularly it relates to connectors of the type incorporating a mechanism for retracting circuit contacts, thereby yielding a low or zero insertion force required for inserting an associated printed circuit board assembly. Still more particularly, the invention relates to an improved electrical connector having an improved linear cam contact actuating mechanism.

2. State of the Prior Art

Printed circuit board assemblies for mounting and interconnecting electronic components are well-known. Various types of connectors for making physical and electrical interconnection with printed circuit board assemblies are also well-known. Multiple printed circuit board assemblies are often interconnected through associated connectors in panel-type assemblies.

As technology provides for the fabrication of integrated circuits having ever-increasing numbers of circuits per integrated circuit chip, it becomes desirable to provide increased number of connector contacts on the mounting multilayer printed circuit boards so that interconnections can be made through the system. The smaller sizes of integrated circuit packages with their increasing number of pin contacts, has resulted in multilayer printed circuit assemblies that have insufficient pin connections along a single edge to make the requisite contact connections in the system. This has led to the development of providing connector contacts along the side edges of the multilayer printed circuit assembly, as well as at the back or internal edge of the assembly. Such arrangement of course must account for the insertion and removal of printed circuit board assemblies.

.A connector arrangement permitting making contact on three sides of a multilayer printed circuit board assembly can include a connector mounted on the rear edge of the printed circuit board assembly that mates with a connector block assembly mounted in the back panel of the cabinet housing. Connectors of this type utilize mating pin and receptacle combinations that provide electrical connection and are retained in place by the friction contact between the pins and mating receptacles when the assembly is inserted. In order to facilitate insertion and removal of the printed circuit board assembly, it is desirable to have the connectors associated with the side edges of the assembly to be of a type that can be activated into making electrical contact after the assembly is inserted in the back panel connectors, and to disengage electrical and physical contact prior to attempting to remove the assembly from the cabinet.

Connectors exist in the prior art having connector electrical contacts for engaging electrical contact surfaces on associated printed circuit board assemblies, and including actuating mechanisms for urging the connector contacts out of engagement with the printed circuit board assembly. With the connector contacts retracted, the associated printed circuit board assembly can be inserted in the connector utilizing very little insertion force. This low insertion force gives rise to the name Zero Insertion Force (ZIF) connectors. Advantages of ease of insertion and removal of the printed circuit board assembly, minimization of contact wear, and maximization of the number of connector contact for this type of connector have been recognized and described in the prior art.

One example of a low insertion force cam actuated printed circuit board connector is disclosed in U.S. Pat. No. 3,899,234 to Yager et al. It describes an arrangement having a plurality of electrical contacts to be brought into contact with an associated printed circuit board through cam actuation. It describes an elongated contact drive member lying freely at the bottom of a printed circuit board receiving aperture, and is utilized to cause movement to a drive member for opening and closing the contacts. It relies mainly on the spring action of the contact for causing the contacts to close.

Another type of low insertion force cam actuated printed circuit board connector is shown in U.S. Pat. No. 3,478,301 to Conrad, et al. It describes a connector having a plurality of contacts held normally open for allowing ease of insertion of a printed circuit board. Before the printed circuit board is completely inserted, it engages a rotatable cam mechanism that causes the contacts to be brought into contact with the printed circuit board as the board is completely inserted. This type of cam operation of course requires that the printed circuit board be inserted parallel to the contact.

A connector having a hollow shell mounted over contacts and vertically movable within a housing, with the shell activated by an elongated cam rod inside the outer housing, is described in U.S. Pat. No. 4,021,091 to Anhalt et al. The cam is shown to be longitudinally movable to shift the shell downwardly for cam actuating the contacts.

A connector that functions to make contact with a printed circuit board within a matched pair of camming blocks is described in U.S. Pat. No. 3,997,231 to Sherwood. The contact activation is caused by moving a sliding exterior member. The exterior cam activator includes pairs of inclined slots, one pair positioned at each end of the connector, and arranged to cooperate with a pair of rods spanning the internal width of the connector. The rods in the associated slots are arranged such that the axes of the rods describe a horizontal plane and determine the relative position of the connector elements.

Another type of low insertion force connector for making electrical connection between a printed circuit board and other circuitry is described in U.S. Pat. No. 4,179,177 to Lapraik. A connector having an elongated outer housing with a longitudinal channel along the bottom thereof and having ramps formed in the bottom of the channel is described for cooperating with a plurality of contacts mounted within the outer housing on either side of the channel. An elongated cam is arranged for operation within the channel and cooperates with an inner housing for causing the contacts to be open and closed as the cam is moved upwardly and downwardly on the ramp. The cam is shown to have an inclined slot at each end thereof. Pins are inserted through the outer housing and the associated slots for causing an upwardly and downwardly extending force as the cam is moved backward and forward. The slots through the cam are positioned such that the strength of the cam member is greatly reduced and is a source of failure of the connector.

The connectors that require transverse pins or rods for cooperation with the camming mechanism preclude the connectors from being mounted closely together if repair of the connector is to be accomplished without totally disconnecting the connector from its associated support assembly.

OBJECTS

It is a primary object of the present invention to provide a new and improved zero or low insertion force connector for printed board assemblies.

Another object of the invention is to provide an improved zero or low insertion force connector having an improved linear cam actuating mechanism.

Still another object of the invention is to provide a zero or low insertion force connector having an improved linear cam actuating mechanism that utilizes a pair of ramps in the connector body to actuate connector contacts into electrical contact with an associated printed circuit board aseembly and eliminates the need for transverse pins in the connector.

Yet a further object of the invention is to provide an improved zero or low insertion force connector having an improved linear cam actuator that can be longitudinally removed from the connector without disassembling the connector from an associated support structure.

Another object of the invention is to provide improved zero or low insertion force connectors that can be mounted on supporting assemblies in close physical proximity to one another.

A further object of the invention is to provide an improved and strengthened linear cam actuator for use in a zero or low insertion force connector for minimizing connector failure due to breakage of the cam actuator.

These and other more specific and detailed purposes and objectives will be readily apparent from a consideration of the drawings and description of the invention that follows.

SUMMARY OF THE INVENTION

In accordance with the present invention, there is provided a zero or low insertion force connector capable of being mounted and supported upon a support assembly for making external electrical connection between electrical conductors supported on a printed circuit board assembly and external circuits. The connector includes an elongated outer housing having a centrally located opening and having a channel extending longitudinally along the bottom thereof. The bottom of the channel has a plurality of spaced apart ramps located longitudinally long the length thereof. A plurality of electrical contacts are mounted longitudinally along said outer housing having a first contact portion positioned within said outer housing and a second portion extending through said housing for connection with the external circuit. The contacts are mounted on either side of the longitudinal channel, and the first portions include bowed segments for providing a predetermined force for making contact with the printed circuit board assembly when in place. An elongated cam actuating mechanism having longitudinal groove along the sides is positioned in the channel. The lower surface of the cam is configured to mate with the ramps in the bottom groove such that transversed motion of the cam is accomplished when the cam is longitudinally activated. The outer housing has an aperture in each end thereof and includes an external ramp structure mounted on each end thereof, each in an operative relationship to an associated one of the apertures. The elongated cam actuator is of a length sufficient to extend completely through the length of said outer housing and the apertures at the ends thereof, and includes mating ramp structures for cooperating with the external ramps mounted at the ends of the housing, the ramps being oppositely disposed from the ramps at the bottom of the channel and inclined in the same direction of movement. An interior shell structure, or riser, includes means for slideably engaging the grooves in the cam actuating mechanism, and functions to move perpendicularly to the longitudinal movement of the cam actuator. The shell includes a plurality of openings at the sides thereof whereby the contacts are given access to the interior of the inner shell. Upper portions engage the bowed portion of the contacts and cause the contacts to be urged toward the sides of the outer housing and out of engagement with the contacts on the printed circuit board assembly when the cam actuator causes the inner shell to be moved for disengagement. The cam actuator causes the inner shell to be forced downwardly allowing the contacts through resilient spring action to make contact with the printed circuit board assembly when the cam actuator is activated by forcing the ramps at the ends thereof to engage the external ramps on the housing.

Figure 6:
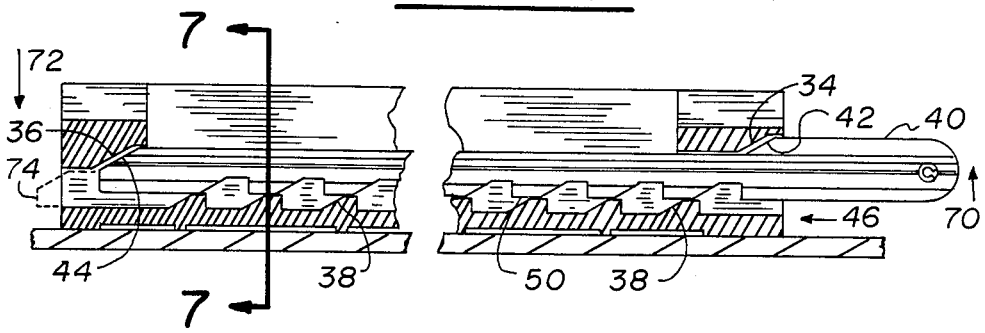
FIG. 6 is a side view connector assembly drawing, having parts cut away to illustrate interior operational relationships, the connector having the cam activated and the contacts open.

FIG. *7a* is a cross-sectional view of the connector taken along lines 7—7 in FIG. 6, illustrating the parts relationship when the connector is open.

FIG. *7b* is a cross-sectional view of the connector taken along line 7—7 in FIG. 6, illustrating the parts relationship when the connector is closed.

FIG. *7c* is a cross-sectional view of the interior shell riser element.

Figure 8:
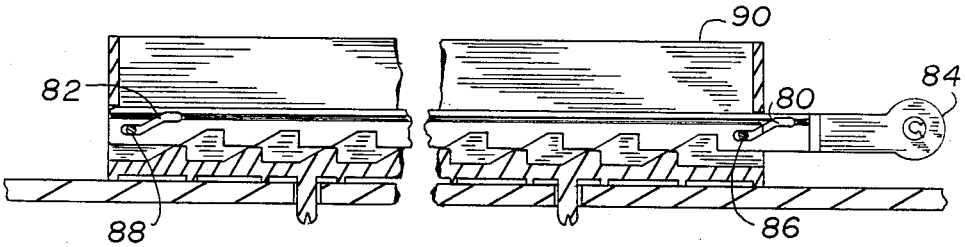
PRIOR ART FIG. 8

FIG. 8 is a side view of a prior art low insertion force connector having parts broken away to illustrate the operational elements.

Figure 9:
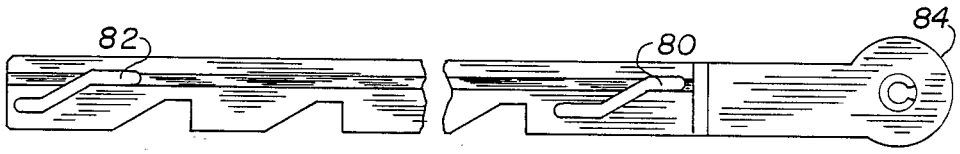
PRIOR ART FIG. 9

FIG. 9 is a side view of a prior art cam actuator.

Figure 10:
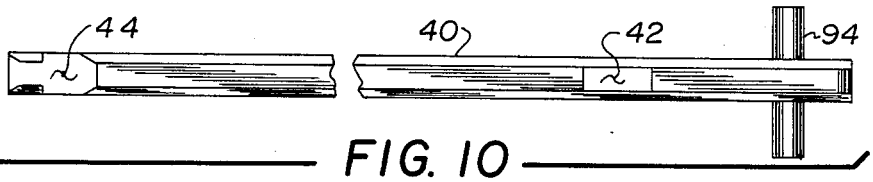

FIG. 10 is a top view of the improved cam actuator of the invention.

Figure 11:
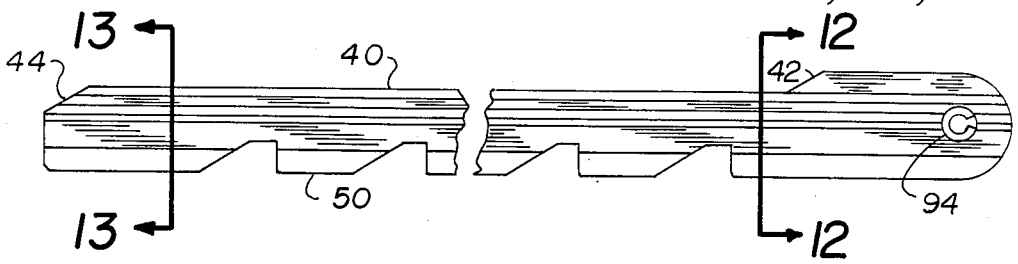

FIG. 11 is a side view of the cam actuator illustrated in FIG. 10

Figure 12:
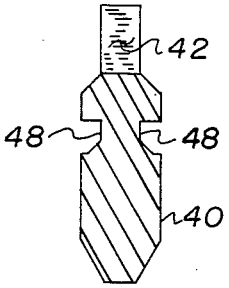

FIG. 12 is a cross-sectional view of the cam actuator taken along lines 12—12 in FIG. 11.

Figure 13:
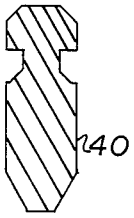

FIG. 13 is a cross-sectional view of the cam actuator taken along line 13—13 in FIG. 11.

DESCRIPTION OF THE PREFERRED EMBODIMENT

Figure 1:
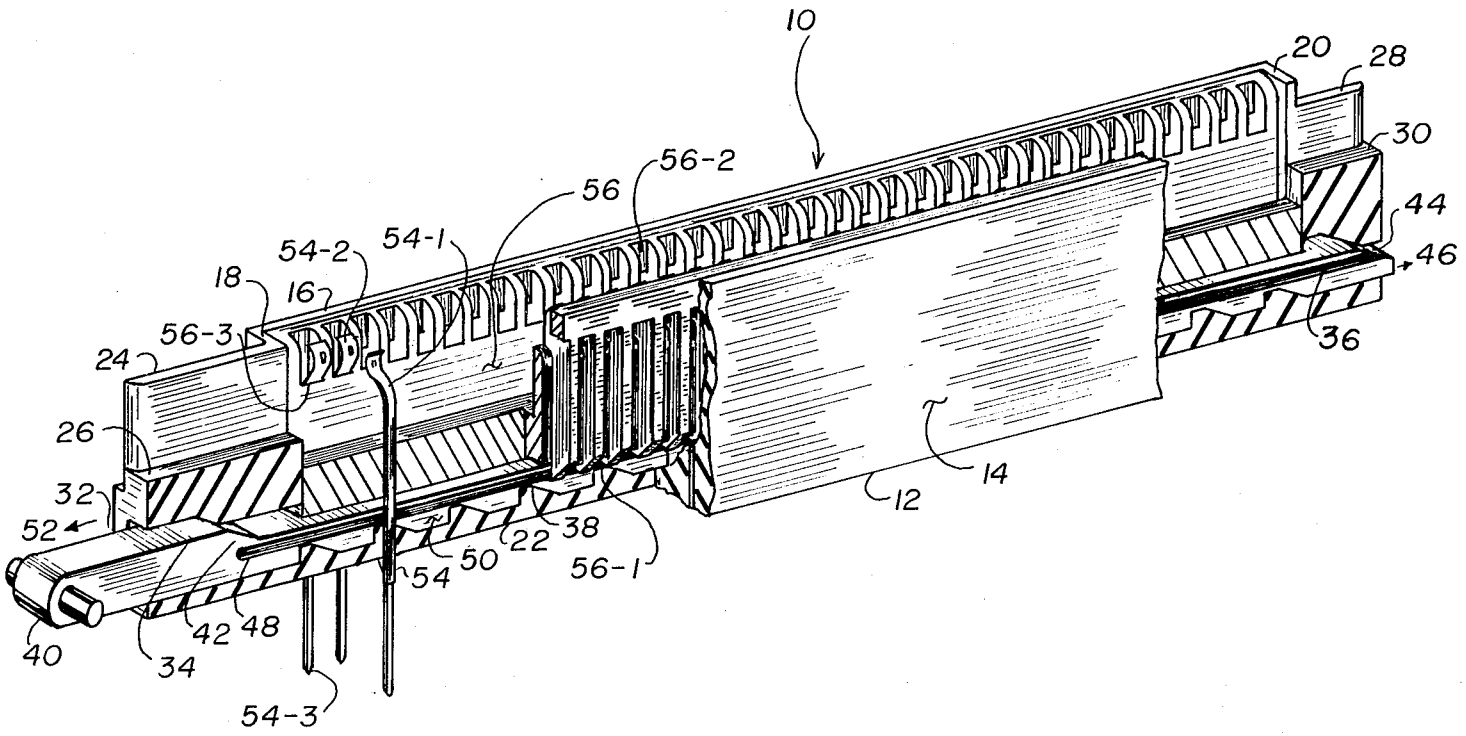
FIG. 1 is a perspective view of the connector having portions broken away to illustrate interrelationships of the connector elements.

FIG. 1 is a perspective view of the connector having portions broken away to illustrate interrelationships of the connector elements. The connector 10 is provided for making electrical contact between a printed circuit board assembly and external electronic circuits, neither of which is shown in detail. The printed circuit board assembly can be a type known in the art utilized for mounting circuit components such as integrated circuits, and having conductive pads mounted thereon for making electrical interconnection through connector 10 to the external circuits. These pads would normally be at an edge of the printed circuit board assembly which would be adapted for insertion in connector 10. It is not deemed necessary to describe the printed circuit board assemblies in more detail, nor to illustrate them in the drawings, nor to illustrate or describe in detail the circuitry to which the connector is affixed, since these are well-known in the art and would not aid appreciably in an understanding of the present invention.

The connector 10 includes an outer housing 12 having a pair of substantially parallel side walls 14 and 16, and first and second ends 18 and 20. The outer housing 12 includes a bottom portion 22. The side walls 14 and 16, the ends 18 and 20 and the bottom 22 define a centrally located opening.

At the first end 18, there are a pair of spaced apart upright members 24, one of which is shown and one of which is cut away, defining a slot having a bottom 26. At the second end 20, there is a similarly situated pair of upright members 28, only one of which is shown and the other is cut away, defining a slot having a bottom 30. These slots with the bottoms 26 and 30 define a channel in which the printed circuit board assembly can be inserted and positioned for making electrical contact within connector 10.

At the first end 18 and external to the outer housing 12, there is an extension having an aperture 32 longitudinally in communication with the inner opening, together with a first mating ramp 34. At the second end 20 and external thereto, is a second mating ramp 36.

It will be more clearly shown below, with regard to other figures, that there is a longitudinal channel on the upper surface of bottom 22, with the channel having a plurality of spaced apart ramps 38, with the ramps 38 having predetermined slanted portions with relatively flat tops.

An elongated cam actuator element 40 is longitudinally placed through aperture 32 along the groove in the bottom member 22, and extending along the entire length of connector 10. The elongated cam actuator 40 has a first ramp 42 for mating with mating ramp 34, and a second ramp 44 for mating with mating ramp 36, these pairs of mating ramps causing a downward transverse movement of the elongated cam actuator when it is actuated in the direction of arrow 46. The elongated cam actuator also includes longitudinal grooves 48 along its sides, these grooves being utilized in conjunction with gripping fingers on a cam follower that will be described in more detail below. The elongated cam actuator 40 also includes a lower surface 50 configured to mate with the plurality of spaced apart ramps 38. The plurality of spaced apart ramps 38 and the under surface 50 of the elongated cam actuator 40 functions to provide an upward transverse motion of the cam actuator 40 when it is actuated in the direction of arrow 52.

A plurality of electrical contacts 54 are mounted along the length of the bottom member 22 on either side of the longitudinal channel. The contacts include a bowed portion 54-1 for providing a predetermined force for making contact with the printed circuit board assembly when in place. The contacts 54 include a contact portion 54-2, and a wiring portion 54-3, the latter utilized to make wiring contact with the external circuitry (not shown).

An interior shell 56 serves as a cam riser and includes a plurality of fingers 56-1 that slideably engage the grooves 48 on either side of the elongated cam actuator 40 and function to slideably engage the cam actuator in a manner such that the inner shell structure 56 is caused to move perpindicularly in response to longitudinal movement of the cam actuator 40. The shell 56 includes a plurality of openings 56-2 at the sides thereof whereby the contacts 54-2 are given access to the face of the printed circuit board assembly. The shell 56 also includes a plurality of upper portions 56-3 that engage the bowed portion 54-1 of the contacts 54, and cause the contacts to be urged toward the sides of the outer housing and out of engagement with the printed circuit board assembly when the cam actuator 40 is actuated in the direction of arrow 52. The cam actuator 40 causes the inner shell 56 to be forced downwardly allowing the contacts 54-2 through resilient spring action to make contact with the printed circuit board assembly, when the cam actuator is activated in the direction of arrow 46 resulting in ramps 42 and 44 to mate with mating ramps 34 and 36.

Figure 2:
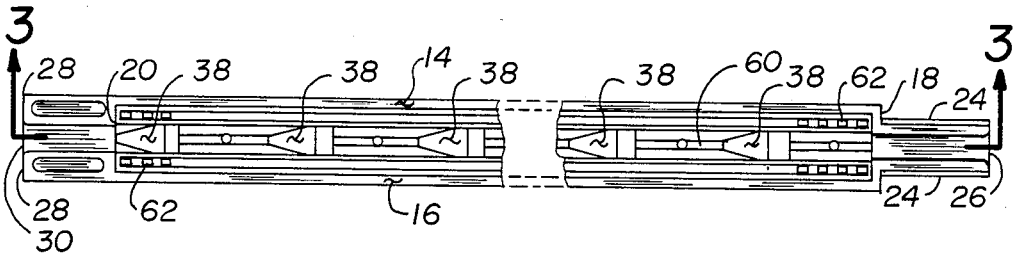
FIG. 2 is a top view of the external housing.

FIG. 2 is a top view of the external housing. The spaced apart ramps 38 are positioned in longitudinal channel 60. Apertures 62 extend along both sides of channel 60 and provide the means for mounting contacts 54. Elements that have been previously described will bear the same reference numerals to the extent possible.

Figure 3:
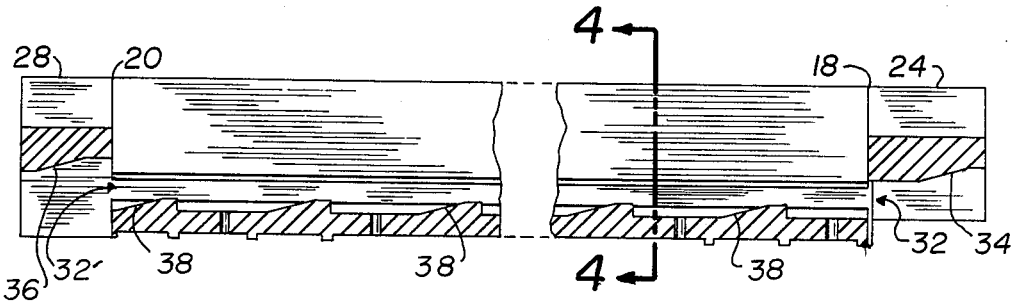
FIG. 3 is a cross-sectional view of the external housing taken along lines 3—3 in FIG. 2.

FIG. 3 is a cross-sectional view of the external housing taken along lines 3—3 in FIG. 2. The external mating ramps 34 and 36 are illustrated in cooperative relationship to aperture 32 through end 18 and 32' through end 20.

Figure 4:
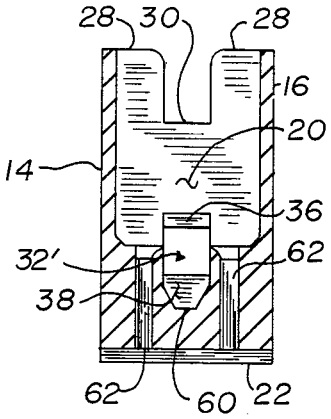
FIG. 4 is a cross-sectional view of the external housing taken at lines 4—4 in FIG. 3.

FIG. 4 is a cross-sectional view of the external housing taken at line 4—4 in FIG. 3. The elongated channel 60 is shown in cooperation with aperture 32'. The face of one of the spaced apart ramps 38 is shown at the bottom of channel 60. The surface of mating ramp 36 is shown beyond the end 20.

Figure 5:
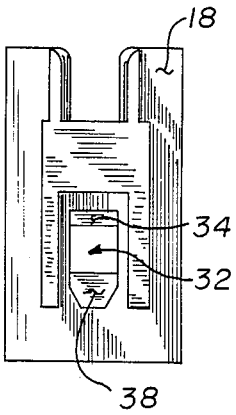
FIG. 5 is an end view of the external housing.

FIG. 5 is an end view of the external housing. It illustrates the relationship of aperture 32 through end 18. The surface of one of the pluralty of spaced apart ramps 38 is shown at the bottom of aperture 32 and a portion of mating ramp 34 is visible at the top thereof.

FIG. 6 is a side view connector assembly drawing, having parts cut away to illustrate interior operational relations, the connector having the cam activated and the contacts open. The elongated cam actuator 40 has its mating surface 50 positioned on the upper surfaces of the plurality of spaced apart ramps 38 wherein transverse motion in the direction of arrow 70 has occurred. Ramp 42 is out of contact with mating ramp 34 and ramp 44 is out of contact with mating ramp 36. When the elongated cam actuator 40 is moved in the direction of arrow 46, as previously described, ramps 42 and 44 engage mating ramp surfaces 34 and 36 respectively, forcing the elongated cam actuator to have transverse motion in the direction of arrow 72 and will take the position shown by dashed outline 74.

Figure 7B:
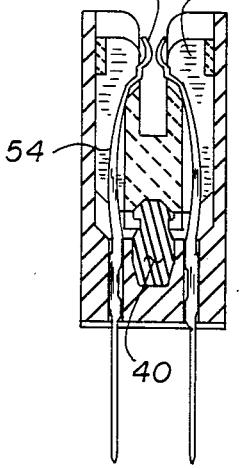
Figure 7A:
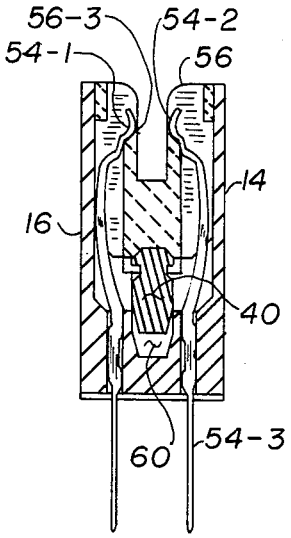

FIG. 7*a* is a cross-sectional view of the connector taken along line 7—7 in FIG. 6, illustrating the parts relationship when the connector is open. The elongated cam actuator 40 is in the raised position and is not at the bottom of channel 60. This raised condition causes the engaging portion 56-3 of the interior shell structure to engage the curved portions 54-1 and to force them laterally toward sides 14 and 16. In such a manner, the contact portions 54-2 are disengaged from the elongated channel and placed in a position out of contact with an associated printed circuit board assembly.

FIG. 7*b* is a cross-sectional view of the connector taken along line 7—7 in FIG. 6, illustrating the parts relationship when the connector is closed. The elongated cam actuator 40 is at the bottom of channel 60, and the shell structure 56 is accordingly lowered. In such an arrangement, the contact portion 54-2 of the contacts 54 are allowed through resilient spring action to go into position to contact an associated printed circuit board assembly.

Figure 7C:
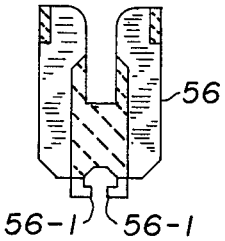

FIG. 7*c* is a cross-sectional view of the interior shell riser element 56. It illustrates the gripping fingers 56-1 arranged for gripping the grooves 48 in the sides of the elongated cam actuator for providing slideable engagement therewith.

FIG. 8 is a side view of a prior art low insertion force connector having parts broken away to illustrate the operational elements. The primary disadvantage of the prior art low insertion force connector is the relationship of the slots 80 and 82 in the cam actuator 84. These slots are adapted for cooperation with transverse pins 86 and 88 which are through the outer housing 90 and the cam actuator 84. The arrangement is such that as the actuator 84 is actuated, it is caused to move up and down on pins 86 and 88. The prior art system is deficient in that the slot 80 and 82 materially reduce the strength of the cam actuator 84 and are a source of structural breakdown. Further, the construction is such that the cam actuator 84 can only be removed from the assembly after pins 86 and 88 are removed. Accordingly, the connector cannot be disassembled without removal from its associated assembly when multiple connectors are mounted in a relatively close proximity to one another.

FIG. 9 is a side view of the prior art cam actuator illustrating slot 80 and 82 in cam actuator 84.

FIG. 10 is a top view of the improved cam actuator of the invention. It illustrates the ramp surfaces 42 and 44 at the ends thereof. A cross member 94 provides a means for gripping for causing actuation of the elongated cam actuator 40.

FIG. 11 is a side view of the cam actuator illustrated in FIG. 10. It illustrates the lower surface 50 adapted for mating with the spaced apart ramp members 38 in the channel 60 in the outer housing. It is understood that the ramps 42 and 44 are positioned to be external to the outer housing opening, and that the configuration is such that substantially additional strength is imparted to the elongated cam actuator 40.

FIG. 12 is a cross-sectional view of the cam actuator taken along lines 12—12 in FIG. 11. It illustrates the grooves 48 along the length thereof and the ramp surface 42.

FIG. 13 is a cross-sectional view of the cam actuator taken along lines 13—13 in FIG. 11.

The foregoing described structure describes an elongated cam actuator 40 that functions in a low insertion force connector which is limited in one direction of movement due to the interaction of the mating surface 50 and the plurality of spaced apart ramps 38, but that can be removed longitudinally from the connector in the opposite direction.

It is understood that the invention has been described with reference to the drawings and to a specific embodiment. It is understood that the description is illustrative, and that various changes and modifications may be recognized by those skilled in the art without departing from the scope and spirit of the invention. Accordingly, what is intended to be protected by Letters Patent is to be determined by the following claims.

What is claimed is:

1. A low insertion force connector for making electrical connection between a printed circuit board assembly and external electrical circuits in combination comprising:

an elongated outer housing have a centrally located opening with a channel extending longitudinally along the bottom thereof, said channel including a plurality of spaced apart ramps along the length thereof, said outer housing having first and second ends;

first and second mating ramp means each mounted on a respective one of said first and second ends of said outerhousing;

a plurality of electrically conductive contacts mounted in said outer housing on either side of said channel, said electrically conductive contacts having first end portions positioned interior said centrally located opening and bowed inwardly for contacting a printed circuit board assembly, and said plurality of electrical contacts having second end portions projecting exterior to said outer housing for making electrical contact with external electrical circuits;

an elongated cam actuator having longitudinal grooves along the side thereof and a first surface configured to mate with said spaced apart ramps along the length of said channel, said elongated cam actuator adapted to be actuated in a longitudinal direction for causing movement in a transverse direction, said elongated cam actuator having first and second ramp means mounted thereon for cooperating with said first and second mating ramp means, wherein said first and second ramp means and said first and second mating ramp means are positioned to cause transverse movement of said elongated cam actuator opposite to said transverse movement caused by said plurality of spaced apart ramps and said first surface of said elongated cam actuator;

a shell housing positioned interior said opening and including cam follower structure having gripping means cooperatively associated with said grooves in said elongated cam actuator for providing positive slideable engagement therewith and yielding transverse movement in said shall housing corresponding to said movement in a transverse direction of said elongated cam actuator, said shell housing further including a pair of upright sections forming a slot for receiving the printed circuit board assembly, each of said upright sections including contact engagement means for abutting said bowed portions of associated ones of said electrically conductive contacts and being adapted to urge said bowed portions to a position disengaged from said printed circuit board assembly when said elongated cam actuator is actuated longitudinally causing said transverse movement, and said bowed portions are allowed to engage said printed circuit board assembly when said elongated cam actuator is actuated to cause the mating of said first and second ramp means with said first and second mating ramp means.

2. A low insertion force connector as in claim 1 wherein said first and second mating ramp means are external to said centrally located opening and are aligned with said channel.

3. A low insertion force connector as in claim 2 wherein said first and second ends each include an aperture in operative relationship to the associated end of said channel, and each of said apertures is of a size and shape to permit a portion of said elongated cam actuator to extend therethrough.

4. A low insertion force connector as in claim 3 wherein said first and second mating ramp means and said plurality of a space apart ramps are positioned in a manner to physically limit the movement of said elongated cam actuator in a first direction while not limiting the movement of said elongated cam actuator in a second direction.

5. A low insertion force connector as in claim 4 wherein said elongated cam actuator is of a length to extend through said first and second apertures, and said first and second ramp means are spaced apart at least the length of said centrally located opening in said outer housing.

6. For use in a low insertion force connector having an elongated outer housing with first and second ends and a centrally located opening with a channel extending longitudinally along the bottom thereof, where the channel includes a plurality of spaced apart ramps along the length thereof, electrically conductive contacts mounted in the outer housing on either side of the channel with bowed portions for making electrical contact with a printed circuit board assembly, and a shell housing positioned in the opening in the outer housing, where the shell housing includes a pair of upright sections forming a longitudinal slot for receiving an associated printed circuit board assembly and each upright section includes a contact engagement member for abutting the bowed portions of associated ones of electrically conductive contacts, the improvement in combination including:

first and second mating ramp means mounted on the first and second ends of the elongated outer housing of the connector respectively, said first and second mating ramp means positioned longitudinal to the channel in the outer housing;

an elongated cam actuator having longitudinal grooves along the side thereof, a first surface configured to mate with the spaced apart ramps along the length of said channel, and adapted to be actuated in a longitudinal direction for causing movement in a first transverse direction, said elongated cam actuator having first and second ramps positioned for cooperation with said first and second mating ramp means for causing movement in a second transverse direction of said elongated cam actuator opposite to said first transverse direction caused by said plurality of spaced apart ramps when said elongated cam actuator is actuated; and a cam follower structure including finger means for cooperating with said longitudinal grooves, and arranged for slidably engaging said elongated cam actuator to the shell housing, whereby transverse movement of the shell housing is caused by the movement of said elongated cam actuator, thereby causing movement of the plurality of electrical conductive contacts.

7. The improved low insertion force connector as in claim 6 wherein said first and second mating ramp means are external to the centrally located opening in the outer housing, and are in operative relationship to the channel, and said elongated cam actuator is of a sufficient length and is configured such that said first and second mating ramps are spaced apart at least the length of the centrally located opening, and said first and second mating ramps are configured to engage associated ones of said first and second ramp means.

8. The low insertion force connector as in claim 7 wherein said first and second mating ramp means and the plurality of spaced apart ramps are positioned in a manner to physically limit the longitudinal movement of said elongated cam actuator in a first direction while not limiting the movement of said elongated cam actuator in a second direction, whereby said elongated cam actuator can be physically removed from the connector assembly for repair.

9. A low insertion force connector for making electrical connection between a printed circuit board assembly and external electrical circuits in combination comprising:

elongated outer housing means having a centrally located opening and a plurality of spaced apart ramps disposed along the length thereof and having first and second ends;

first and second mating ramp means at respective ones of said first and second ends;

electrical contact means mounted in said elongated housing means, each configured for contacting an associated printed circuit board assembly;

elongated cam actuator means having longitudinal grooves along the sides thereof, a first surface configured to mate with said spaced apart ramps, and first and second ramps positioned for cooperation with said first and second mating ramp means, said elongated cam actuator adapted to be longitudinally actuated for causing transverse movement;

shell means positioned within said elongated outer housing means and including a pair of upright sections for forming a slot for receiving the printed circuit board assembly, each of said upright sections including contact engagement means for abutting predetermined portions of associated ones of said contact means; and cam follower means for providing positive slideable engagement between said shell housing means and said elongated cam actuator means, whereby said contact means are urged to a disengaged position from said printed circuit board assembly when said elongated cam actuator is actuated longitudinally causing said transverse movement, and said contact means are allowed to engage said printed circuit board assembly when said elongated cam actuator is actuated to cause the opposite transverse movement by mating of said first and second mating ramp means with said first and second ramps when longitudinally actuated in the opposite direction.

10. A low insertion force connector as in claim 9 wherein said first and second mating ramp means are external to said centrally located opening and are longitudinally aligned with said spaced apart ramp means, wherein said first and second mating ramp means and said plurality of spaced apart ramps are positioned in a manner to physically limit the movement of said elongated cam actuator means in a first direction while not limiting the movement of said elongated cam actuator means in a second direction.

11. A low insertion force connector in claim 10 wherein said first and second ends each include an aperture in operative relationship to the said centrally located opening and each of said apertures is of a size and shape to permit a portion of said elongated cam actuator means to extend therethrough; and said elongated cam actuator means is of a length sufficient to extend through said first and second apertures, and said first and second mating ramps are spaced apart at least the length of said centrally located opening in said outer housing means.

* * * * *

UNITED STATES PATENT AND TRADEMARK OFFICE

CERTIFICATE OF CORRECTION

PATENT NO. : 4,540,228

DATED : September 10, 1985

INVENTOR(S) : Thomas S. Steele

It is certified that error appears in the above-identified patent and that said Letters Patent is hereby corrected as shown below:

In the Claims:

Column 8, Line 53, "shall" should be changed to -- shell --.

Signed and Sealed this

*Third* Day of *December 1985*

[SEAL]

*Attest:*

DONALD J. QUIGG

*Attesting Officer*

*Commissioner of Patents and Trademarks*